US010746485B2

(12) United States Patent
Braceras Devecchi

(10) Patent No.: US 10,746,485 B2
(45) Date of Patent: Aug. 18, 2020

(54) AMBIDEXTROUS STRAIGHT PULL BOLT ACTION WITH CLOSING ROTATIVE SLUGS

(71) Applicant: Saul Angel Braceras Devecchi, Madrid (ES)

(72) Inventor: Saul Angel Braceras Devecchi, Madrid (ES)

( * ) Notice: Subject to any disclaimer, the term of this patent is extended or adjusted under 35 U.S.C. 154(b) by 0 days.

(21) Appl. No.: 16/339,469

(22) PCT Filed: Oct. 2, 2017

(86) PCT No.: PCT/ES2017/000121
§ 371 (c)(1),
(2) Date: Apr. 4, 2019

(87) PCT Pub. No.: WO2018/065642
PCT Pub. Date: Apr. 12, 2018

(65) Prior Publication Data

US 2020/0049436 A1 Feb. 13, 2020

(30) Foreign Application Priority Data

Oct. 7, 2016 (ES) ..... 201600686 U

(51) Int. Cl.
*F41A 3/20* (2006.01)
*F41A 3/30* (2006.01)
*F41A 19/34* (2006.01)
*F41A 3/72* (2006.01)
(Continued)

(52) U.S. Cl.
CPC ..... *F41A 3/20* (2013.01); *F41A 3/30* (2013.01); *F41A 19/34* (2013.01); *F41A 3/72* (2013.01); *F41A 21/482* (2013.01); *F41A 35/06* (2013.01)

(58) Field of Classification Search
CPC .... F41A 3/20; F41A 3/30; F41A 19/34; F41A 3/72; F41A 21/482; F41A 35/06
See application file for complete search history.

(56) References Cited

U.S. PATENT DOCUMENTS 1,124,071 A * 1/1915 Stamm ..... F41A 15/14 42/16
3,257,749 A * 6/1966 Donaldson ..... F41A 17/46 42/16
3,461,731 A 8/1969 Lewis
(Continued)

FOREIGN PATENT DOCUMENTS

DE 37 18 431 A1 12/1988
DE 37 18 431 C2 4/1990
WO 83/02153 A1 6/1983

OTHER PUBLICATIONS

International Search Report of PCT/ES2017/000121, dated Jan. 15, 2018.

*Primary Examiner* — Michelle Clement
(74) *Attorney, Agent, or Firm* — Collard & Roe, P.C.

(57) ABSTRACT

An ambidextrous straight-line manually operated bolt with rotatable closing slugs has a bolt body or casing having a square cross section and housing inside it forming a hollow main cylinder with 3 closing lugs on its head, a second hollow cylindrical body that fits inside the first cylinder, the top half of which is open at the front and on the sides of which rest two flat gears, multiplier gears that act on the flat gears, and a firing pin or striker that passes in between the two hollow cylindrical bodies.

1 Claim, 5 Drawing Sheets

(51) Int. Cl.
*F41A 21/48* (2006.01)
*F41A 35/06* (2006.01)

(56) References Cited

U.S. PATENT DOCUMENTS

| | | | | |
|---|---|---|---|---|
| 3,791,060 | A | 2/1974 | Weaver | |
| 4,547,988 | A * | 10/1985 | Nilsson | F41A 3/18 42/16 |
| 5,148,619 | A * | 9/1992 | Badali | F41C 7/06 42/16 |
| 6,279,258 | B1 * | 8/2001 | Hashman | F41A 3/20 42/16 |
| 6,345,460 | B2 * | 2/2002 | Hashman | F41A 3/20 42/16 |
| 6,393,961 | B1 * | 5/2002 | Ockenfuss | F41A 3/20 42/16 |
| 9,115,941 | B2 * | 8/2015 | Tertin | F41A 3/20 |
| 10,551,136 | B2 * | 2/2020 | Carimati Di Carimate | F41A 3/20 |
| 2001/0029687 | A1 * | 10/2001 | Hashman | F41A 3/20 42/16 |
| 2003/0167909 | A1 | 9/2003 | Matter | |
| 2010/0175290 | A1 | 7/2010 | Duplessis et al. | |
| 2010/0223830 | A1 * | 9/2010 | Martin | F41A 3/20 42/69.02 |
| 2014/0311005 | A1 * | 10/2014 | Tertin | F41A 3/20 42/16 |
| 2016/0238334 | A1 * | 8/2016 | Pflaumer | F41A 35/06 |
| 2019/0277587 | A1 * | 9/2019 | Carimati Di Carimate | F41A 3/72 |

* cited by examiner

AMBIDEXTROUS STRAIGHT PULL BOLT ACTION WITH CLOSING ROTATIVE SLUGS

CROSS REFERENCE TO RELATED APPLICATIONS

This application is the National Stage of PCT/ES2017/000121 filed on Oct. 2, 2017, which claims priority under 35 U.S.C. § 119 of Spanish Application No. U201600686 filed on Oct. 7, 2016, the disclosures of which are incorporated by reference. The international application under PCT article 21(2) was not published in English.

FIELD OF THE ART

The ambidextrous straight pull bolt action with closing rotative slugs is comprised in the sector of firearms.

BACKGROUND OF THE INVENTION

There are several guns with straight pull bolt actions, for example, the Blaser rifle (PN DE3718431A 1988 Dec. 22 DW198901 DE3718431C 1990 Apr. 12 DW199015 TI Cylindrical breech for repeating rifle—BLASER H JAGDWAFFEN ICAI F41A19/34; F41A3/22) uses one, but it lacks closing rotative or rotating slugs, uses a "daisy" with steel petals which open up like a flower once it has been checked that the gun is locked. There are others, such as: (Browning (Acera), Pirkan Ase (Lynx), Merkel, Österreichischen Waffenfabriks (Steyr), Schmidt-Rubin, Ross, all of which are provided with several contrivances for locking the gun when firing. None of them, however, operates the same way the straight pull bolt action with rotating closing slugs does.

DESCRIPTION OF THE INVENTION

1 The straight pull bolt action with rotative slugs is characterized by the horizontal implementation of the opening and closing thereof. Its linear movement can be backward or forward, without rotating the operative opening/closing handle (01), simply pulling or pushing to operate it.

2 The straight pull bolt action with rotative slugs is characterized by its ambidextrousness, where the operative closing and opening handle (01) can be placed on either side thereof.

3 The straight pull bolt action with rotative slugs is characterized by its smooth handling given its system of multiple gears (5 in total) which accelerate the transmission and convert the straight movement on the two flat gears of the secondary body (05) into the rotative movement of the central bolt body (06*a*) as a result of its helical cut (12) which, as a result of its guide screw (13), makes it, along with its three closing slugs (10), rotate to the right (close) or to the left (open). Upon pulling or pushing (opening or closure of the locking action) the operative opening/closing handle (01), it rotates, imparting said movement to the multiplier gears (three single gears plus one double gear).

It operates as follows: the operative opening/closing handle (01) is attached to the central shaft (02A) which passes through the main gear (02) connected to a small reversing gear (03) which in turn transmits the movement to another double gear (04) (which is attached to another gear (04B) having larger dimensions that is attached to the third gear (04C) by means of a shaft (04A)). The gears (04B and 04C) are in contact with secondary body flat gears (05A), and when the reversing gear (03) transmits movement to the double gear (04) attached to (04B and 04C), the latter mesh with the flat gear (05A), performing backward or forward translational movement for opening or closing the mechanism.

4 The straight pull bolt action with rotative slugs is characterized by allowing the arming of the firing system, in the event of a failed or delayed firing, without opening the bolt (see FIGS. 04 and 05, bolt open and striker armed). The bolt is still in the closed position. The firing system is armed by simply pulling back on the operative opening/closing handle (01) one-sixth of a rotation)(15°). Clearly, in order to completely open the bolt, another one-sixth of a rotation would be required since this is checked with one-third of a rotation)(30°).

5 The straight pull bolt action with rotative slugs is characterized in that the operative opening/closing handle (01) has more force than any of the other straight pull locking actions today for chambering the cartridge in the chamber because the rotation of the operative handle exhibits more force due to the action of the gearbox with multiple gears by applying closing pressure as if it were a manually rotative bolt action.

Figure 1:
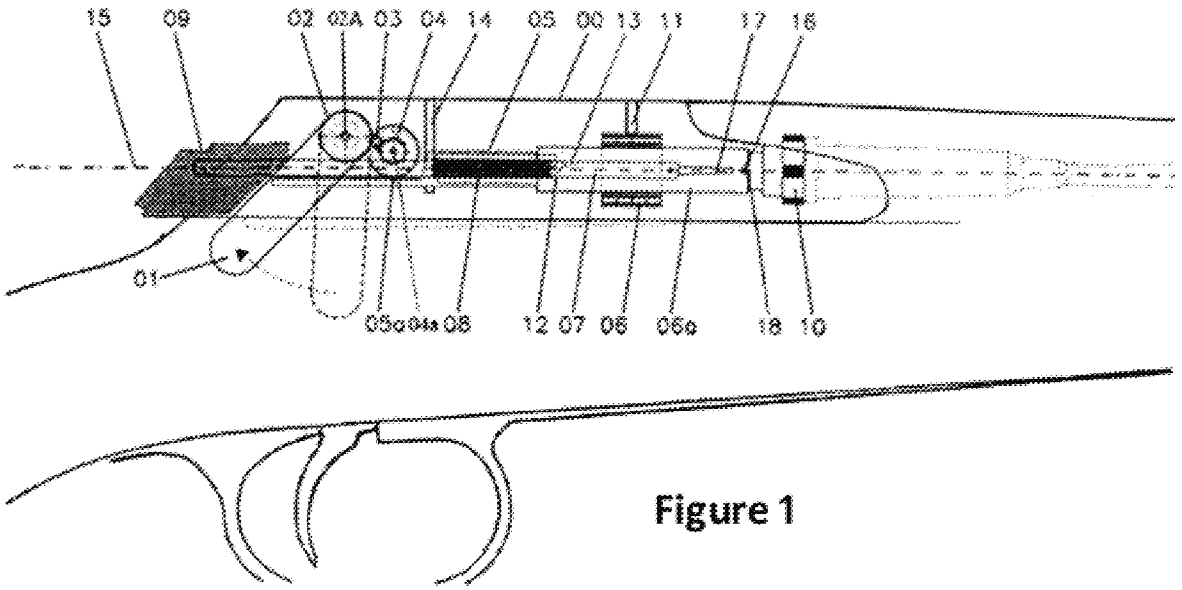
FIG. 1 shows a side view of the straight pull bolt action with rotative slugs (bolt open and striker armed).

Identification of constitutive elements and/or parts:

00 Bolt casing
01 Bolt operative handle
02 Gear
02 A Main shaft
03 Reversing gear
04 Double gear
04A Double gear shaft
05 Secondary body provided with a double flat gear
05A Secondary body flat gears
06 Rotating main body cylindrical bearing
06A Rotating main body
07 Striker
08 Striker spring
09 Striker shroud
10 Head of the bolt action with rotative slugs
11 Rotating main body cylindrical bearing holding elements
12 Rotating main body helical cut
13 Guide screw with bearing
14 Striker body holding element
15 Barrel axis
16 Interlock element for interlocking with the head of the bolt action with rotative slugs
17 Striker tip
18 Notch for interlocking with the head of the bolt action with rotative slugs.

Figure 2:
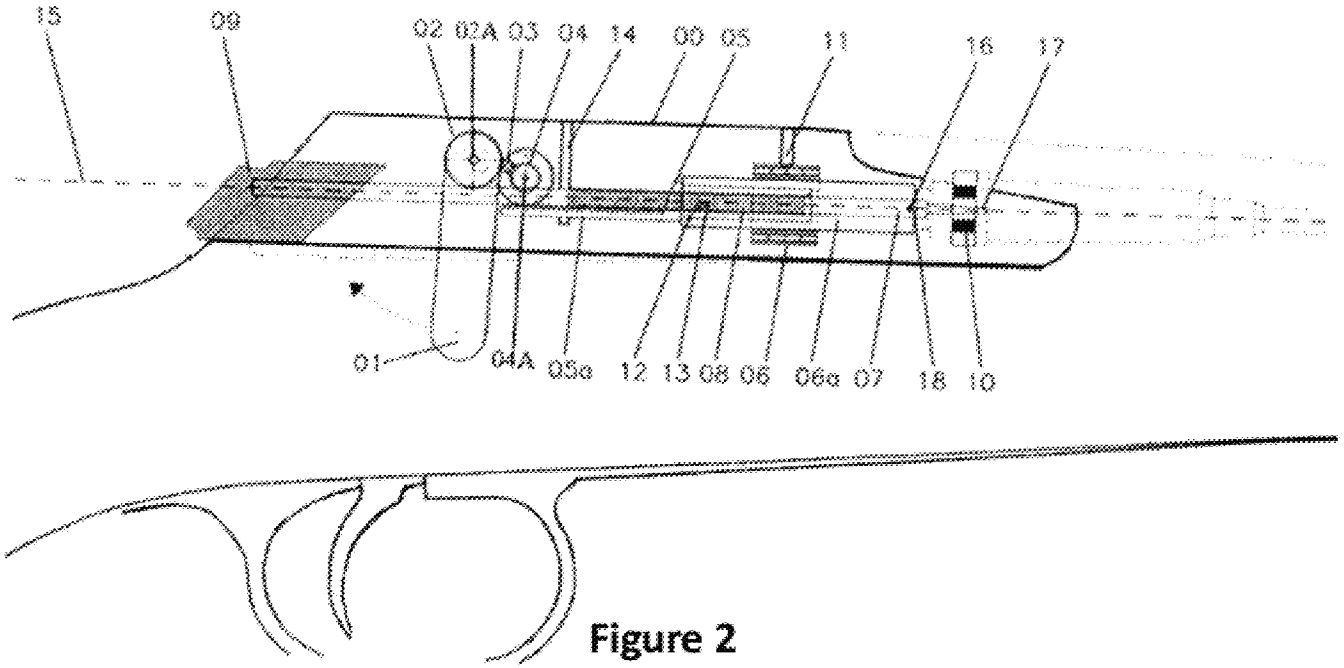

FIG. 2 shows a side view of a straight pull bolt action with rotative slugs (bolt closed and striker fired).

Identification of constitutive elements and/or parts:

00 Bolt casing
01 Bolt operative handle
02 Gear
02A Main shaft
03 Reversing gear
04 Double gear
04A Double gear shaft
05 Secondary body provided with double flat gear
05A Secondary body flat gears
06 Rotating main body cylindrical bearing
06A Rotating main body

Figure 3:
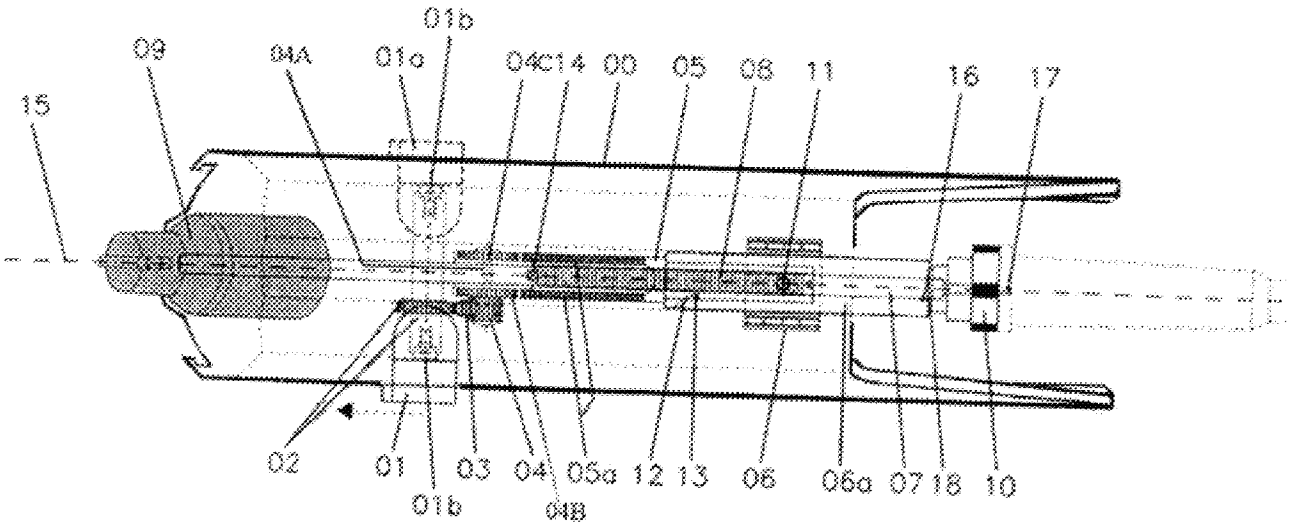

07 Striker
08 Striker spring
09 Striker shroud
10 Head of the bolt action with rotative slugs
11 Rotating main body cylindrical bearing holding elements
12 Rotating main body helical cut
13 Guide screw with bearing
14 Striker body holding element
15 Barrel axis
16 Interlock element interlocking with the head of the bolt action with rotative slugs
17 Striker tip
18 Notch for interlocking with the head of the bolt action with rotative slugs FIG. 3 shows a top view of the straight pull bolt action with rotative slugs (bolt closed and striker fired).

Figure 4:
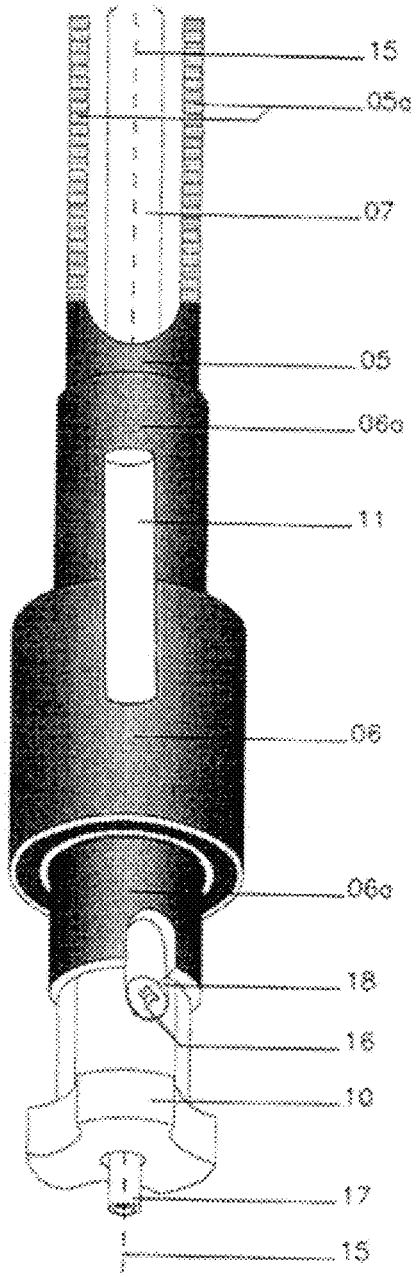

Identification of constitutive elements and/or parts:

00 Bolt casing
01 Bolt operative handle
02 Gear
02A Main shaft
03 Reversing gear
04 First double gear
04A Double gear shaft
04B Second double gear
04C Third Gear attached by the shaft (04A) to the double gear (04B)
05 Secondary body provided with double flat gear
05A Secondary body flat gears
06 Rotating main body cylindrical bearing
06A Rotating main body
07 Striker
08 Striker spring
09 Striker shroud
10 Head of the bolt action with rotative slugs
11 Rotating main body cylindrical bearing holding elements
12 Rotating main body helical cut
13 Guide screw with bearing
14 Striker body holding element
15 Barrel axis
16 Interlock element for interlocking with the head of the bolt action with rotative slugs
17 Striker tip
18 Notch for interlocking with the head of the bolt action with rotative slugs FIG. 4 shows the notch for blocking the rotation of the head with rotative slugs (bolt closed and striker fired)

Figure 5:
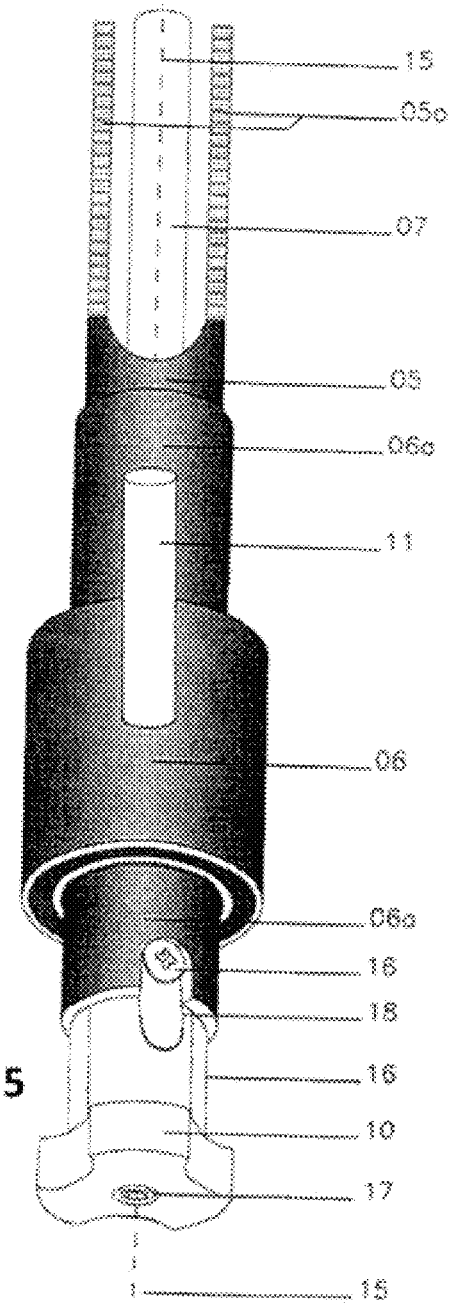

Identification of constitutive elements and/or parts:

05 Secondary body provided with flat gear
05A Secondary body flat gears
06 Rotating main body bearings
06A Rotating main body
07 Striker
10 Head of the bolt action with rotative slugs
11 Bearing holder
15 Barrel axis
16 Interlock element for interlocking with the head with rotative slugs
17 Striker tip
18 Notch for interlocking with the head with rotative slugs FIG. 5 shows the notch for blocking the rotation of the head with rotative slugs (bolt open and striker armed)

Identification of constitutive elements and/or parts:

05 Secondary body provided with flat gear
05A Secondary body flat gears
06 Rotating main body bearings
06A Rotating main body
07 Striker
10 Head of the bolt action with rotative slugs
11 Bearing holder
15 Barrel axis
16 Interlock element for interlocking with the head with rotative slugs
17 Striker tip
18 Notch for interlocking with the head with rotative slugs

PREFERRED EMBODIMENT OF THE INVENTION

The bolt as a whole is made up of a bolt body and a frame in which it moves. The bolt body or casing (00) has a square cross section of 3×3 and 14.5 cm in length, housing movable parts inside it, namely:

1) A hollow main cylinder (06*a*) with the three closing slugs (10) on its head (an upper closing slug at 0° degrees and the other two closing slugs at 120° on either side) and a side cut at 45°. At the head of the upper slug, it has, at the front, a pin with a recess and the pin spring which, upon coming into contact with the chamber, will allow the closing slugs to rotate. When the upper slug is not in contact with the chamber, this pin spring will be in charge of blocking them from rotating.

In the front part of the closing slugs there are: a movable claw extractor, an active ejector, and the recessed pin with the pin spring which disables rotation thereof if it is being pressed by the front of the chamber.

The head of the bolt body with its rotative slugs (10) is interchangeable so as to enable receiving different diameters of the cartridges chambered in the interchangeable barrels.

2) A second hollow cylindrical body (05) that fits inside the first or main hollow cylindrical body, the top half of which is open at the front and on the right and left inner sides of which rest two flat gears (05*a*). It furthermore has on the rear outer side a screw (13) holding a bearing that fits inside the cut (12) of the hollow main cylinder with the closing slugs on its head.

3) Multiplier gears (three single gears (02, 03, and 04C, the latter shown in FIG. 3, plus a third double gear (04 and 05), two of which (the double gears (04 and 05) and another identical gear (04C, the latter shown in FIG. 3)) are attached by a shaft (04-A) to impart movement to the flat gears (05A) on either side of the second hollow cylindrical body (05). Through the backward and forward movement of the operative opening and closing handle (01), the multiplier gears (2, 03, and 04) multiply the travel over the flat gears (05A) of the secondary hollow cylindrical body (05) which, by moving forward or backward, rotates the cylinder of the rotating main body (05) with the closing slugs on its head (10), which thereby allows closing the bolt in the event of clockwise rotation or opening the bolt in the event of counterclockwise rotation. This rotation only occurs when the closing head with its slugs (10) comes into contact with the chamber, which prevents the slugs from freely rotating during the translational phase of the bolt from back to front and vice versa.

4) A firing pin or striker (07) with the shroud (09), with its corresponding tooth, fits inside the trigger and its spring (08) that passes in between the two hollow cylindrical upon going through a fixed arm or striker body holding element (14) which is part of the bolt body having a rectangular cross section which encompasses the two cylindrical hollow bodies (06A and 05) which fit inside one another, thereby allowing the movement thereof in the longitudinal direction of the weapon. This movement is what allows firing the cartridge, if it is a forward movement, as a result of the spring, or of arming the firing system if it is a backward movement, where the spring is constricted.

When the operative opening and closing handle (01) is driven backward by the user's hand (opening movement), it imparts a rotational movement to the shaft* (02A) which goes through the bolt body having a rectangular cross section from side to side, causing the first gear (02) to multiply the rotation on a second reversing gear (03), and thus on the third double gear (04) attached by a secondary shaft to another identical gear (04C, the latter shown in FIG. 3). Said movement will cause the second hollow cylindrical that fits inside the first or main hollow cylindrical body to travel 15 mm, thereby producing a clockwise rotation of 15° to release each slug from its slot.

In the first one-sixth of the rotational movement of the operative opening and closing handle, the second hollow cylindrical body moves back 4 millimeters in the straight area of the cut at 45°, therefore it does not rotate, pushing the shroud of the firing pin, arming the firing system. However, the bolt remains closed.

Continuing with the backward movement of the operative opening and closing handle (01) which will generate an additional one-sixth of a rotation, the closing slugs (10) rotate and are released from their slots, allowing the bolt to move backward at the will of the user to eject the cartridge (if there is one) from the chamber, and, at the end of its backward travel, taking in the new cartridge from the magazine.

With the reverse movement, i.e., the user's hand pushing the operative opening and closing handle (01) forward, lifts the entire mechanism of the bolt body or receiver towards the chamber, taking in the new cartridge to place it in the chamber. When the recessed pin comes into contact with a spring of the head of the upper closing slug, the clockwise rotation thereof is produced, allowing the closure of the bolt.

The main shaft (02-A, seen best in FIG. 3) which goes through the receiver from side to side is what allows, according to the side where it is screwed in (on the right for right-handed users or on the left for left-handed users), the operative opening and closing handle to be ambidextrous.

The bolt body moves as a result of rails provided in the frame thereof, and in the lower front part thereof rests the trigger system, and in front of that is the magazine with cartridges, and finally the interlock element for the interchangeable barrel or barrels.

INDUSTRIAL APPLICATIONS

The mentioned invention has several industrial applications:

a) It can be used to develop a completely novel sport rifle with a unique bolt action given its advantages in terms of safety, execution speed, and precision of desmodromic movements. Furthermore, its ambidextrousness allows it to be used by any type of shooter, right- or left-handed, making it the only one of its kind worldwide. Being a short-stroke bolt action allows use of interchangeable barrels.

b) It can be used in several brands of already existing sport rifles, which are potentially those most interested in the production thereof.

The invention claimed is:

1. An ambidextrous straight pull bolt action with rotatable closing slugs comprising:

a bolt body or casing having a square cross section of 3×3 and 14.5 cm in length, the bolt body or casing enclosing the following movable parts:

a) a first hollow cylindrical body having a head with three closing slugs, the closing slugs comprising an upper closing slug at 0° and two other closing slugs at 120° on either side of the upper closing slug, and a side cut at 45°, wherein a pin with a recess and pin spring is disposed at a head of the upper slug, in a front area thereof, wherein the pin spring, upon contacting the chamber, allows the closing slugs to rotate and when the upper slug is not in contact with the chamber, the pin spring blocks the closing slugs from rotating;

b) a movable claw extractor and an active ejector disposed in the front area of the closing slugs, wherein the pin with the pin spring is being pressed by the front of the chamber;

c) a second hollow cylindrical body that fits inside the first hollow cylindrical body, the second hollow cylindrical body having a top half that is open at a front and has two flat gears that rest on a left and right inner side thereof, wherein a screw holding a bearing is disposed on a rear outer side of the second hollow cylindrical body, the screw fitting inside the cut of the first hollow cylindrical body;

d) multiplier gears in the form of three single gears plus a double gear, wherein the double gear and one of the single gears are attached by a shaft to impart movement to the flat gears on the second hollow cylindrical body; and e) a firing pin or striker with a shroud, wherein the firing pin or striker has a corresponding tooth and fits inside a trigger and has a spring that passes in between the two hollow cylindrical bodies upon going through a fixed arm or striker body holding element which is part of the bolt body, thereby allowing a movement thereof in a longitudinal direction of a weapon.

* * * * *